US008397432B1

(12) United States Patent
Ferez

(10) Patent No.: US 8,397,432 B1
(45) Date of Patent: Mar. 19, 2013

(54) DOOR ASSEMBLY FOR STORM SHELTER

(75) Inventor: Marcio Ferez, Doral, FL (US)

(73) Assignee: Tornado Challenger Corporation, Doral, FL (US)

( * ) Notice: Subject to any disclaimer, the term of this patent is extended or adjusted under 35 U.S.C. 154(b) by 0 days.

(21) Appl. No.: 13/306,225

(22) Filed: Nov. 29, 2011

(51) Int. Cl.
*E05F 9/00* (2006.01)
*B25B 27/14* (2006.01)

(52) U.S. Cl. ..... 49/356; 49/354; 49/386; 29/281.1

(58) Field of Classification Search ..... 49/356, 49/386, 387, 354, 460; 29/281.1, 267, 281.3, 29/281.5; 269/228, 55, 71, 905; 254/120, 254/134; 16/306–308
See application file for complete search history.

(56) References Cited

U.S. PATENT DOCUMENTS

| | | | | | |
|---|---|---|---|---|---|
| 513,913 | A * | 1/1894 | Garland | 49/357 |
| 1,210,341 | A * | 12/1916 | Matthews et al. | 49/96 |
| 1,564,844 | A * | 12/1925 | Gardner | 292/341 |
| 1,841,187 | A * | 1/1932 | Johnson | 160/95 |
| 1,879,994 | A * | 9/1932 | Schaffert | 49/356 |
| 5,301,469 | A * | 4/1994 | Lyons, Sr. | 49/386 |
| 5,335,451 | A * | 8/1994 | Druzynski | 49/379 |
| 6,039,200 | A * | 3/2000 | Armor | 220/263 |
| 6,966,151 | B1 * | 11/2005 | Harbers, Jr. | 49/506 |
| 6,996,875 | B2 * | 2/2006 | Chiang | 16/82 |
| 7,194,840 | B2 * | 3/2007 | Zimmermann | 49/324 |
| 2008/0100071 | A1 * | 5/2008 | Browne et al. | 292/341.17 |
| 2010/0071265 | A1 * | 3/2010 | Molnar et al. | 49/280 |

* cited by examiner

*Primary Examiner* — Katherine Mitchell
*Assistant Examiner* — Scott Denion
(74) *Attorney, Agent, or Firm* — Sanchelima & Associates, P.A.

(57) ABSTRACT

A door assembly for protecting structural enclosures with an opening with a frame assembly mounted to and surrounding the opening. The enclosures are typically storm shelters. A door panel is hingedly mounted to the frame assembly along a longitudinal hinge axis. Outer and inner lever assemblies are pivotally mounted to fixed reference axes outside of the frame assembly. Force multipliers provide the torque necessary to move the door panel between two extreme positions. The lever assemblies used to create the pertinent moments of force are telescopic, having the longest dimensions that the space permits. Users can readily open and close the heavy hingedly mounted door assemblies. To further facilitate the smooth opening and closing of the door panel, gas spring assemblies and/or coil springs can be utilized.

7 Claims, 10 Drawing Sheets

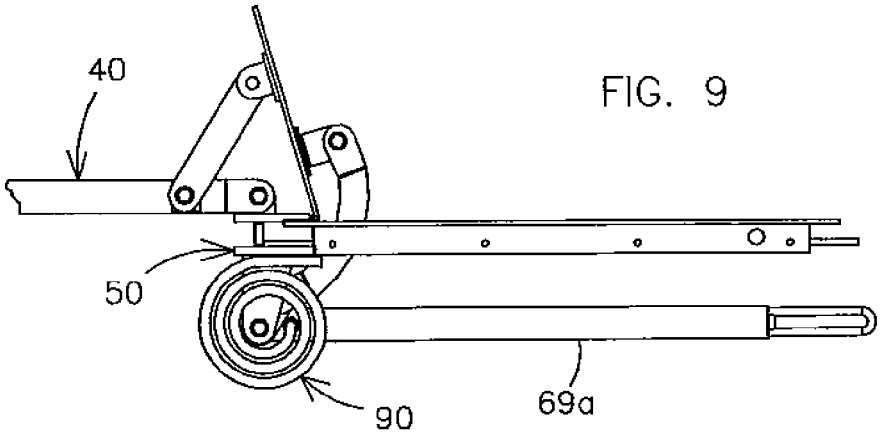
FIG. 9
FIG. 9A
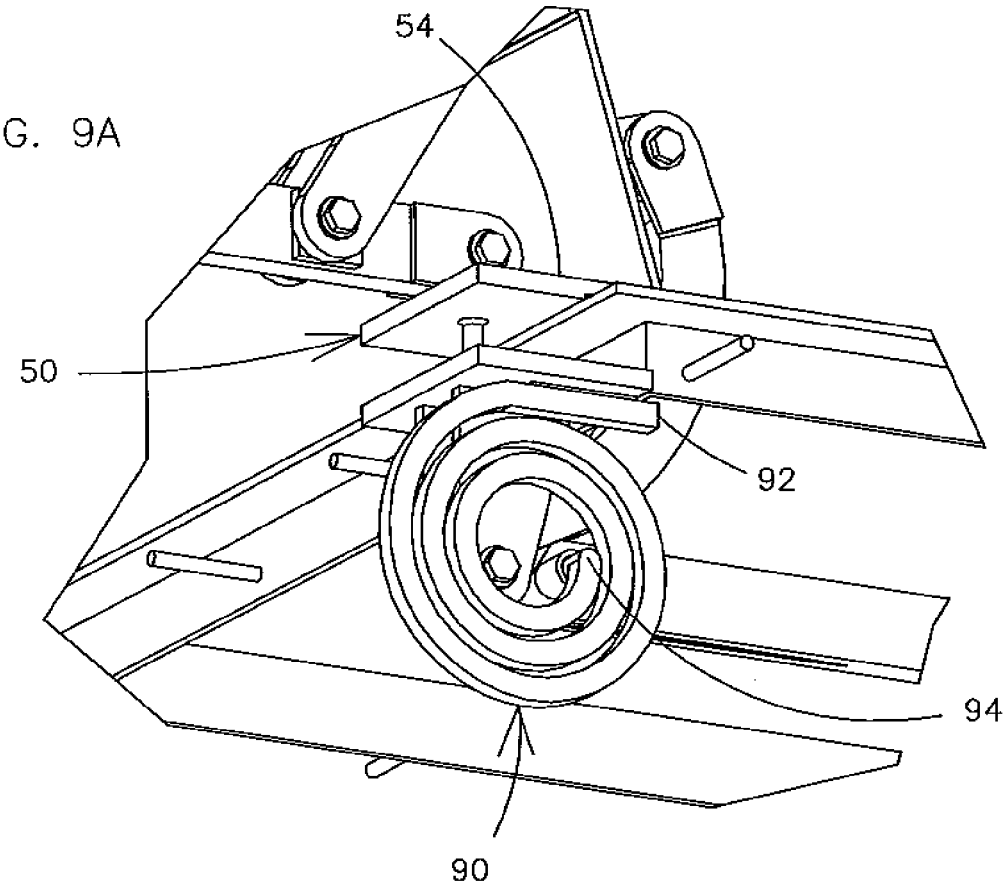

DOOR ASSEMBLY FOR STORM SHELTER

BACKGROUND OF THE INVENTION

1. Field of the Invention

The present invention relates to a door assembly, and more particularly, to such a door assembly that can be opened and closed with the application of a relatively small force. This type of door assembly is typically used for storm shelters that require its users to move relatively heavy doors in a short time.

2. Description of the Related Art

Several designs for door assemblies have been designed in the past. None of them, however, include the features claimed herein that overcome the need to apply a force of considerable magnitude to open and close a relatively heavy door, especially when this task needs to be accomplished in a relatively small period of time.

The present invention is particularly suited when used in storm shelters where a reliable door assembly is needed. Reliable door assemblies are typically heavy. With FEMA specifications, the door assemblies are heavy and difficult to open and close. This requires the application of relatively large forces.

In many instances, children, the elderly, or handicapped persons cannot operate the door assemblies. When a storm approaches a dwelling with a storm shelter, these individuals need to rapidly operate the door assembly by themselves. Thus, there is a need for this type of door assembly that can be readily operated.

SUMMARY OF THE INVENTION

It is one of the main objects of the present invention to provide a door assembly that can be easily opened and closed with the application of a relatively small force when compared to the weight of the activated door member.

It is another object of this invention to provide a door assembly that will reliably protect its users in an enclosure or storm shelter.

It is yet another object of this invention to provide such a door assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 9 is similar to the previous two figures wherein assembly 60 is shown rotated at 180 degrees with coil spring 90 at maximum expansion countering the moment of force of door panel 32 tending to move the latter counterclockwise.

FIG. 9A is an enlarged detail view of the portion of inner lever assembly 60 wherein coil spring 90 is mounted.

DETAILED DESCRIPTION OF THE EMBODIMENTS OF THE INVENTION

Figure 1:
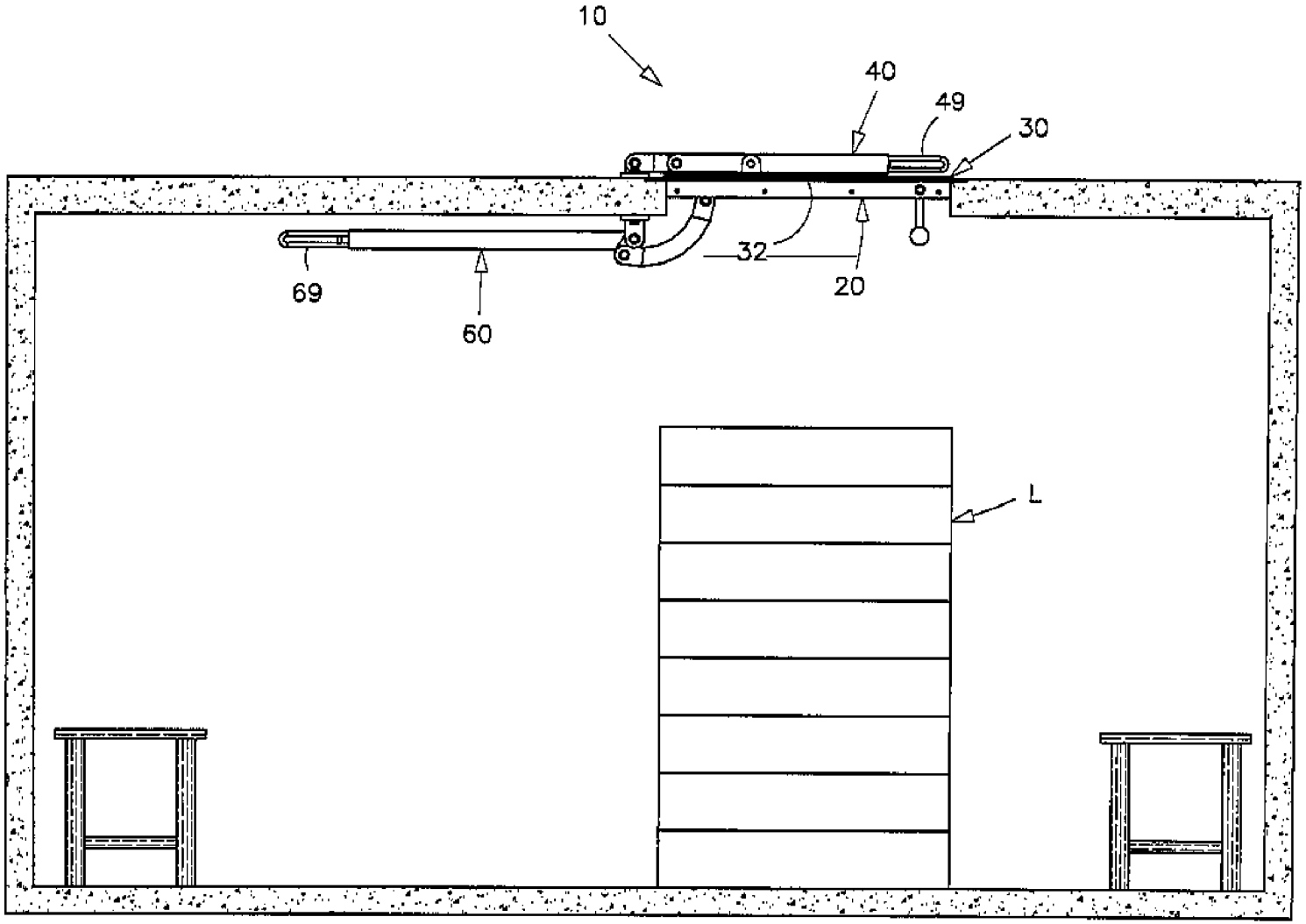
FIG. 1 represents an elevational cross-sectional side view of a storm shelter utilizing the door assembly incorporating an embodiment for the present invention with the door in the closed position.

Referring now to the drawings, where the present invention is generally referred to with numeral 10, it can be observed that it basically includes a frame assembly 20 and a door panel assembly 30 hingedly mounted to the former. In FIG. 1, a cross-sectional view of a storm shelter is represented where door assembly 10 is shown in the closed position. A ladder L is internally disposed to facilitate the access and exit of users. This is one of two extreme positions for door panel 32. Telescopic outer lever assembly 40 is shown in the horizontal position, or the zero-degree position. Telescopic inner lever assembly 60 is also shown in the horizontal position that will be referred to as the 180-degree position. In this position for door panel 32, users may either be inside the protected area or outside.

Figure 2:
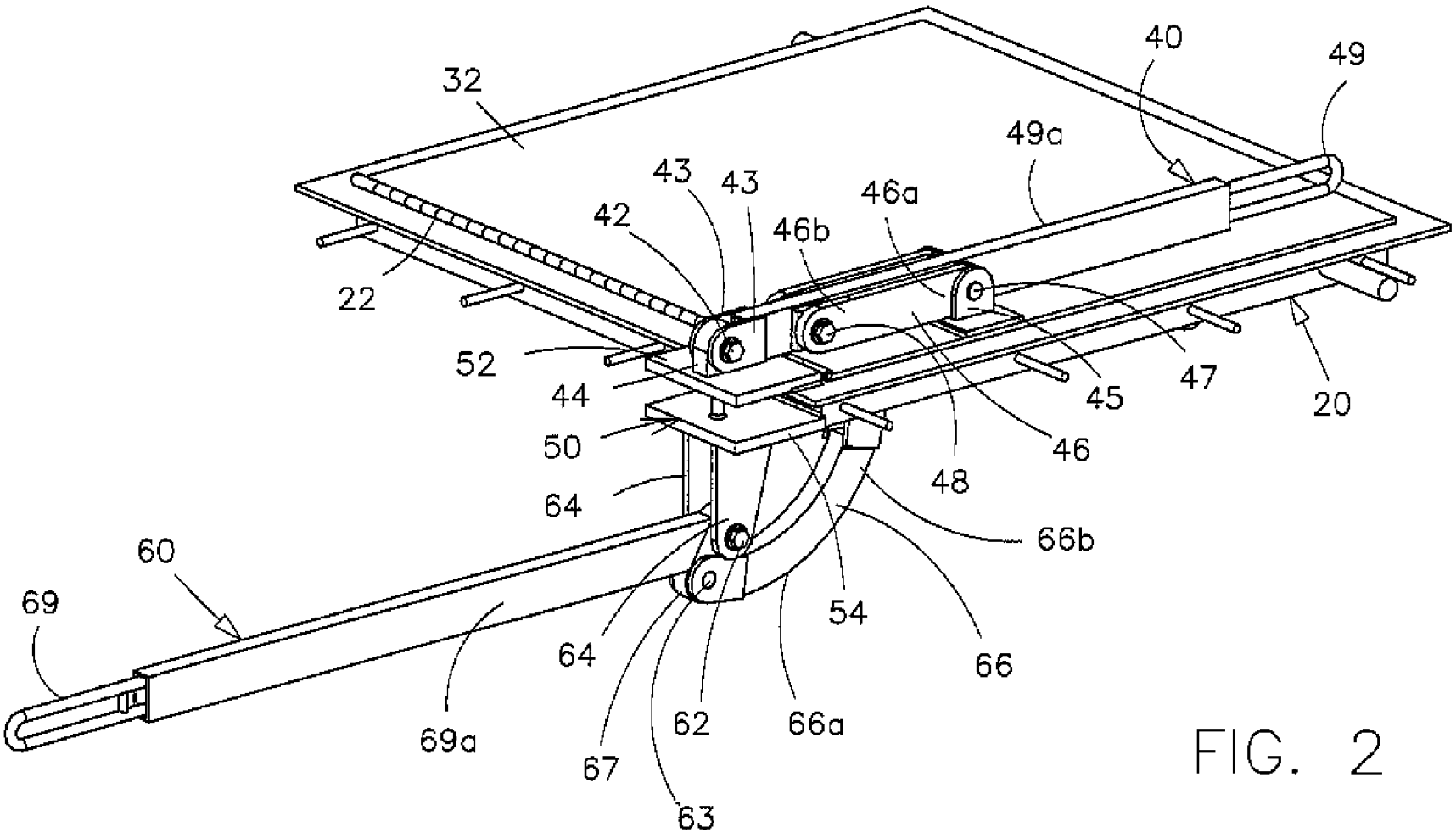
FIG. 2 shows an isometric view of the door assembly represented in the previous figure, as seen from above at an angle. The outer and inner lever assemblies 40; 60 are horizontally disposed with door panel 32 in the closed position.

FIG. 2 shows door panel 32, outer lever assembly 40, and inner lever assembly 60 in the horizontal position. Both outer and inner lever assemblies 40 and 60 are shown in the retracted position in FIG. 2. Slidable outer lever member 49 is selectively receivable inside outer lever member 49*a* of telescopic outer lever assembly 40. Slidable inner lever member 69 is selectively receivable inside inner lever member 69*a* of telescopic inner lever assembly 60. Hinge member 22 keeps door panel 32 pivotally mounted to frame assembly 20. Hinge member 22 defines a longitudinal pivoting axis for door panel 32. Lever assembly 40 is pivotally mounted to a fulcrum point defined by pivoting headed pin or shaft 42. Shaft 42 is journaled by bearing member 44 and one end of outer lever member 49*a* is pivotally mounted thereto through end plates 43 rigidly mounted to one end of member 49*a*. Connecting arm 46 is pivotally mounted to pivoting shaft 47 at one end 46*a* and to pivoting shaft 48 at the other end 46*b*. Shaft 47 is supported by bearing member 45. Slidable outer lever member 49 selectively and telescopically extends in and out of outer lever member 49*a* of assembly 40 in this embodiment.

Figure 2A:
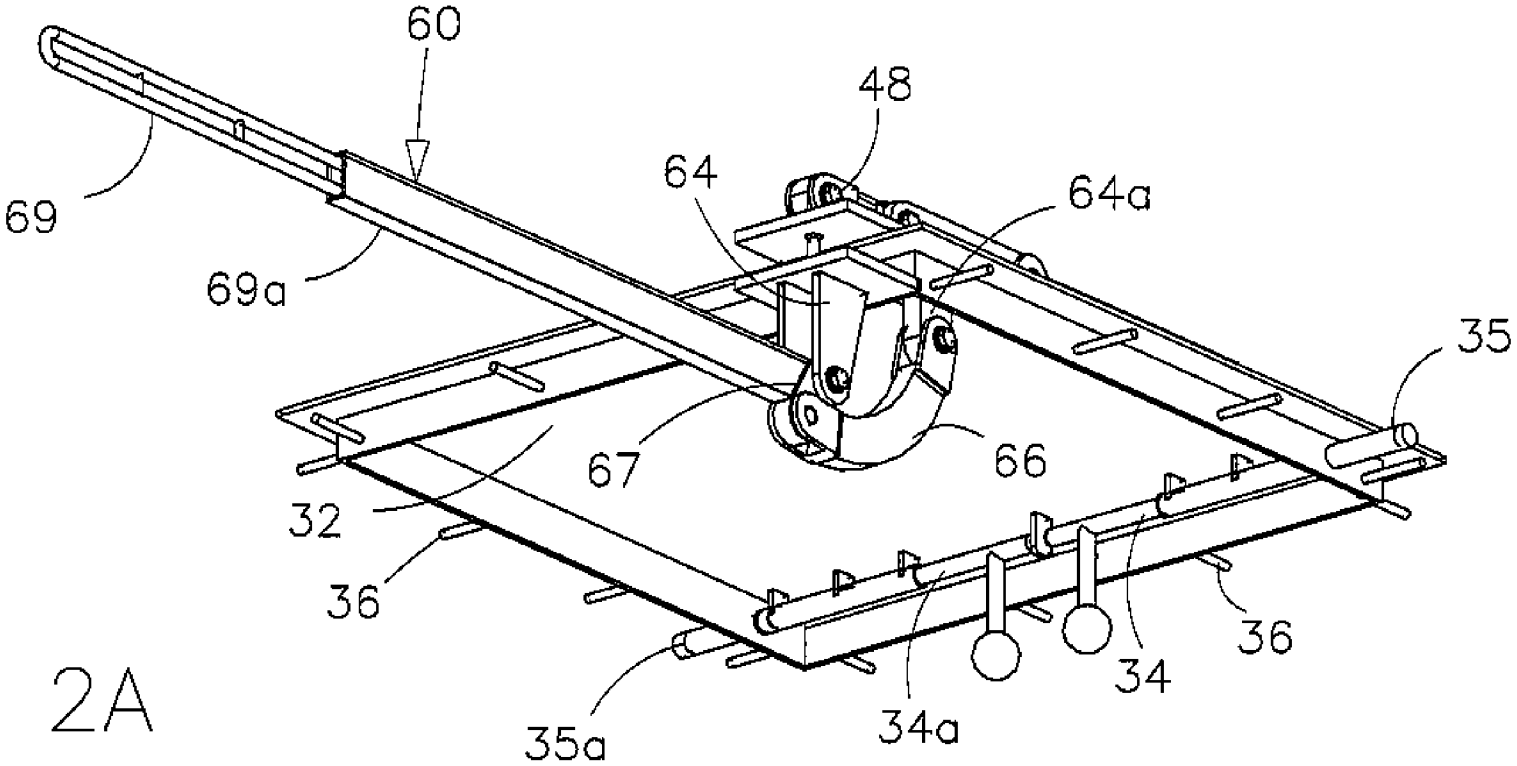
FIG. 2A is an isometric view of the door assembly shown in the previous figures seen from below at an angle and with slidable inner lever member 69 extended out and ready to be actuated.

Inner lever assembly 60 is pivotally mounted to headed pin or shaft 62, as best seen in FIG. 2. Curved connecting arm 66 is pivotally mounted at one end to door panel 32 and the other end to inner lever assembly 60, as best seen in FIG. 2A. FIG. 2A shows inner lever assembly 60 with inner lever member 69 in the extended position.

In the embodiment shown in FIG. 2, spacer assembly 50 is shown to include outer and inner plates 52 and 54, respectively, mounted at a parallel and spaced apart relationship to provide fixed reference supporting points for bearing members 44 and 64 (described below). The position of these fixed reference points can vary and different equivalent ways of providing them are contemplated. This unitary design provides a practical supporting mechanism for positioning the fulcrum points.

In FIG. 2A, locking pins 34 and 34*a* are shown disengaged in alignment with cooperating tubular members 35 and 35*a*, respectively. When door panel 32 is closed, pins 34 and 34*a* are moved outwardly to be received by tubular members 35 and 35*a*, respectively. Anchoring pins 36 are designed to be embedded in the surrounding structure where frame assembly 20 is mounted.

Figure 3:
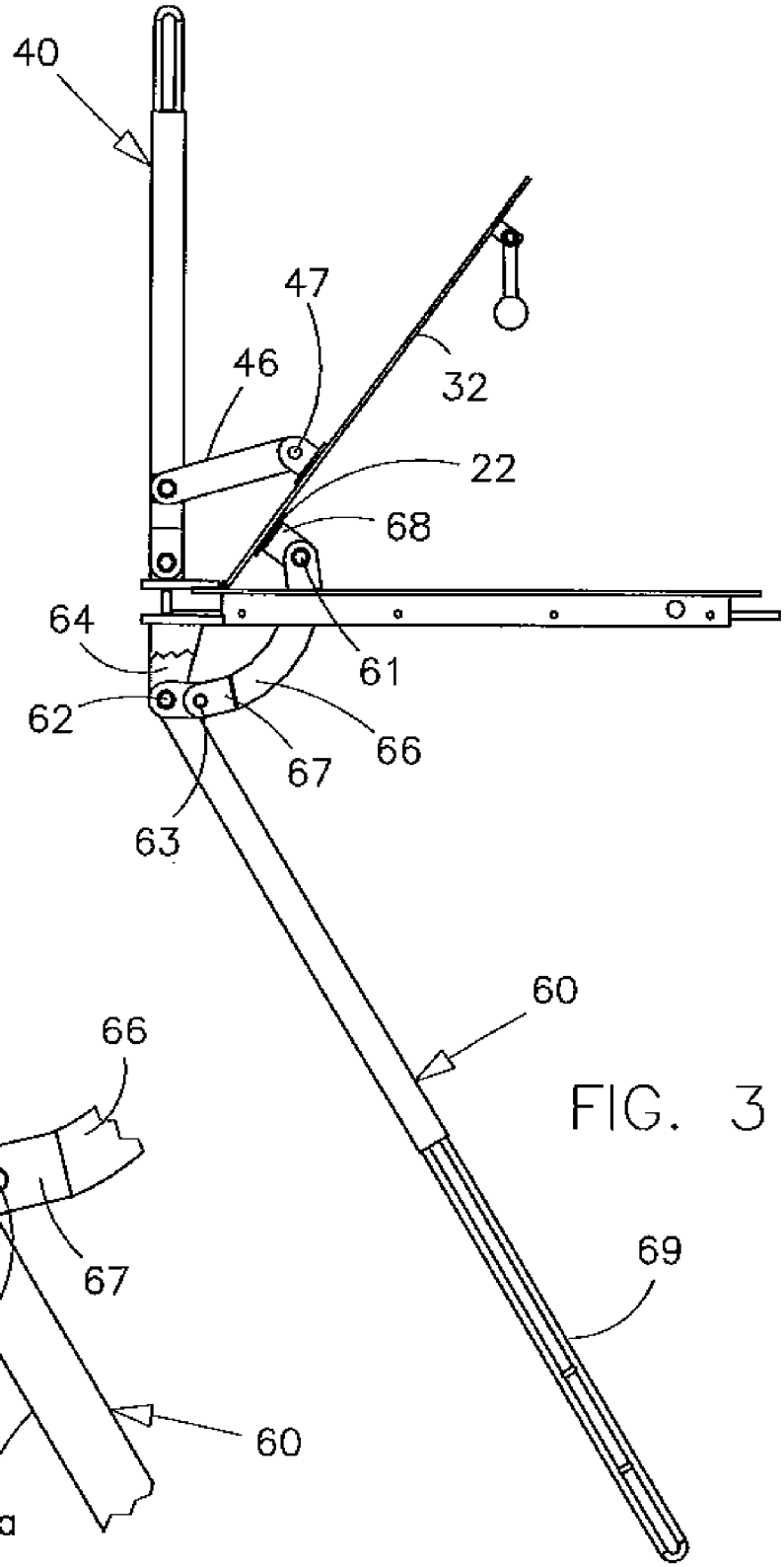
FIG. 3 illustrates a side elevational view of the door assembly represented in the previous figures with the outer lever assembly 40 positioned at 90 degrees and inner lever assembly 60 at approximately 120 degrees. Door panel 32 is at approximately 60 degrees.
Figure 3A:
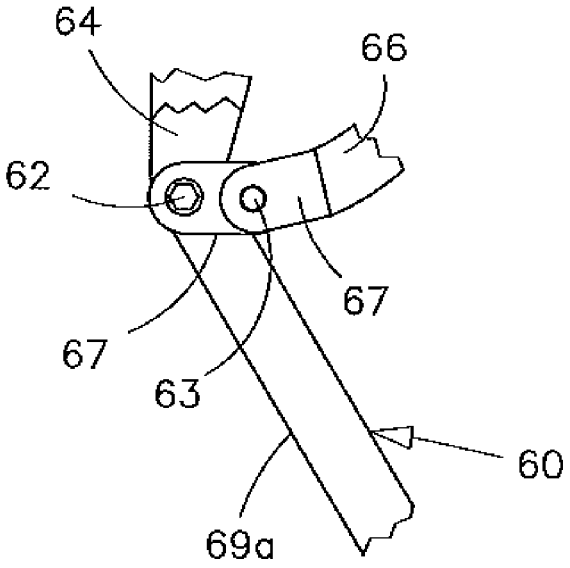
FIG. 3A is an enlarged elevational view of one end of curved connecting arm 66 pivotally mounted to angled plate 67, which in turn is rigidly mounted to inner lever member 69*a*. A portion of bearing member 64 has been removed to facilitate seeing angled plate 67.

In FIG. 3, a user has moved (from inside the enclosure) inner lever assembly 60 to approximately the 120-degree position with door panel 32 reaching an approximately 60-degree position. Outer lever assembly 40 has moved from the horizontal position (0 degrees) to an approximately 90-degree position. Slidable inner lever member 69 is shown in the maximum distended position in FIG. 3 to achieve maximum leverage and torque to lift door panel 32.

Figure 4:
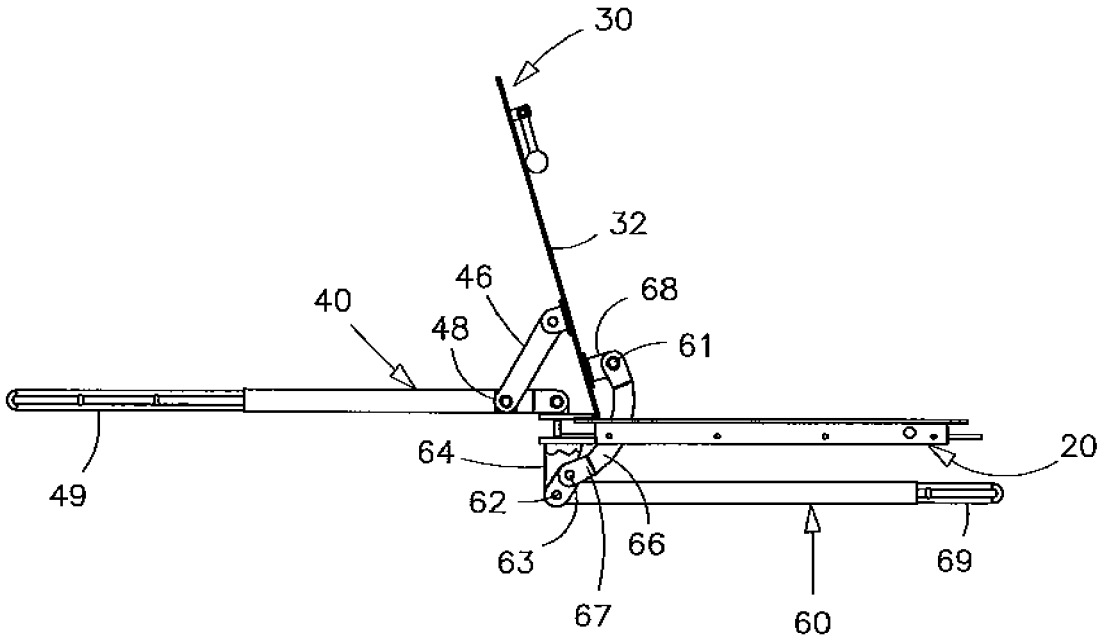
FIG. 4 is a side elevational view of door assembly 10 shown in the previous figures with the outer lever assembly 40 positioned at 180 degrees with door panel 32 at the extreme open position at approximately 120 degrees.
Figure 4A:
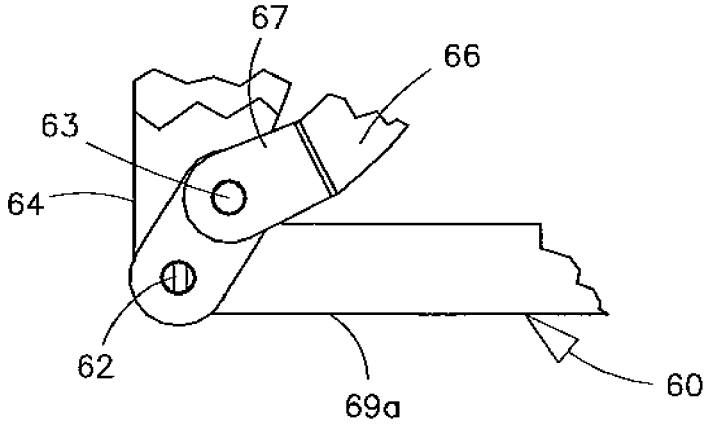
FIG. 4A is an enlarged elevational view of curved connecting arm 66 similar to FIG. 3A, but with inner lever assembly 60 at the zero degrees (horizontal) position (to the right).

In FIG. 4, a user has moved (from outside the enclosure) outer lever assembly 40 to approximately the 180-degree position, placing door panel 32 at approximately a 110-degree position. Slidable outer lever member 49 is slid completely out to achieve maximum leverage or torque. In FIG. 4A, this enlarged view facilitates the viewing of the different elements.

Figure 5:
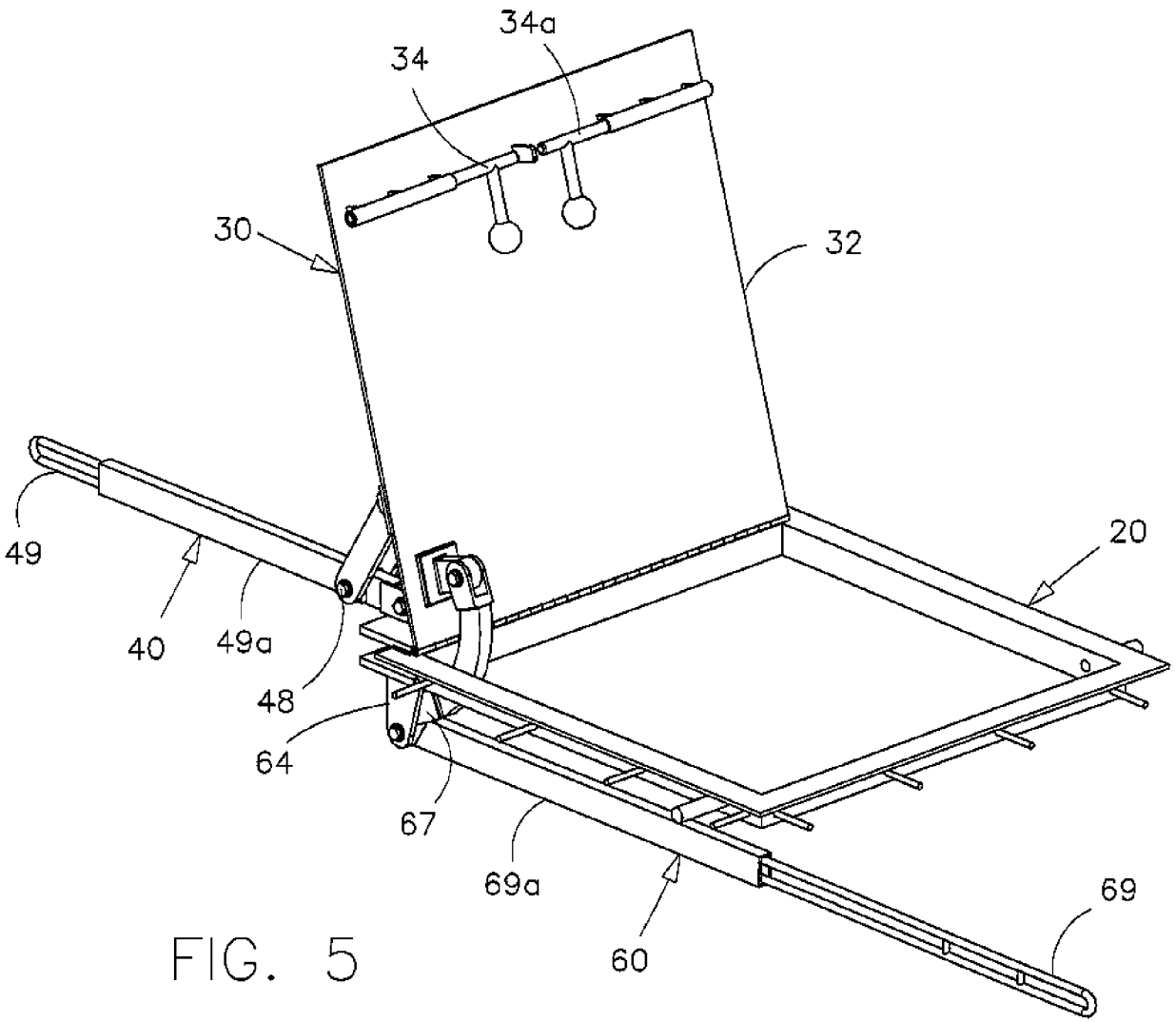
FIG. 5 is an isometric representation of door panel assembly 30 shown in the previous figures with door panel 32 in the extreme open position with slidable inner lever member 69 in the distended position.

FIG. 5 shows door assembly 10 in the open position, ready to be closed by a user inside the protected enclosure. Slidable inner lever member 69 is completely extended out while member 49 is retracted. Locking pins 34; 34*a* have been moved inwardly. Door panel 32 is ready to be closed.

Figure 6:
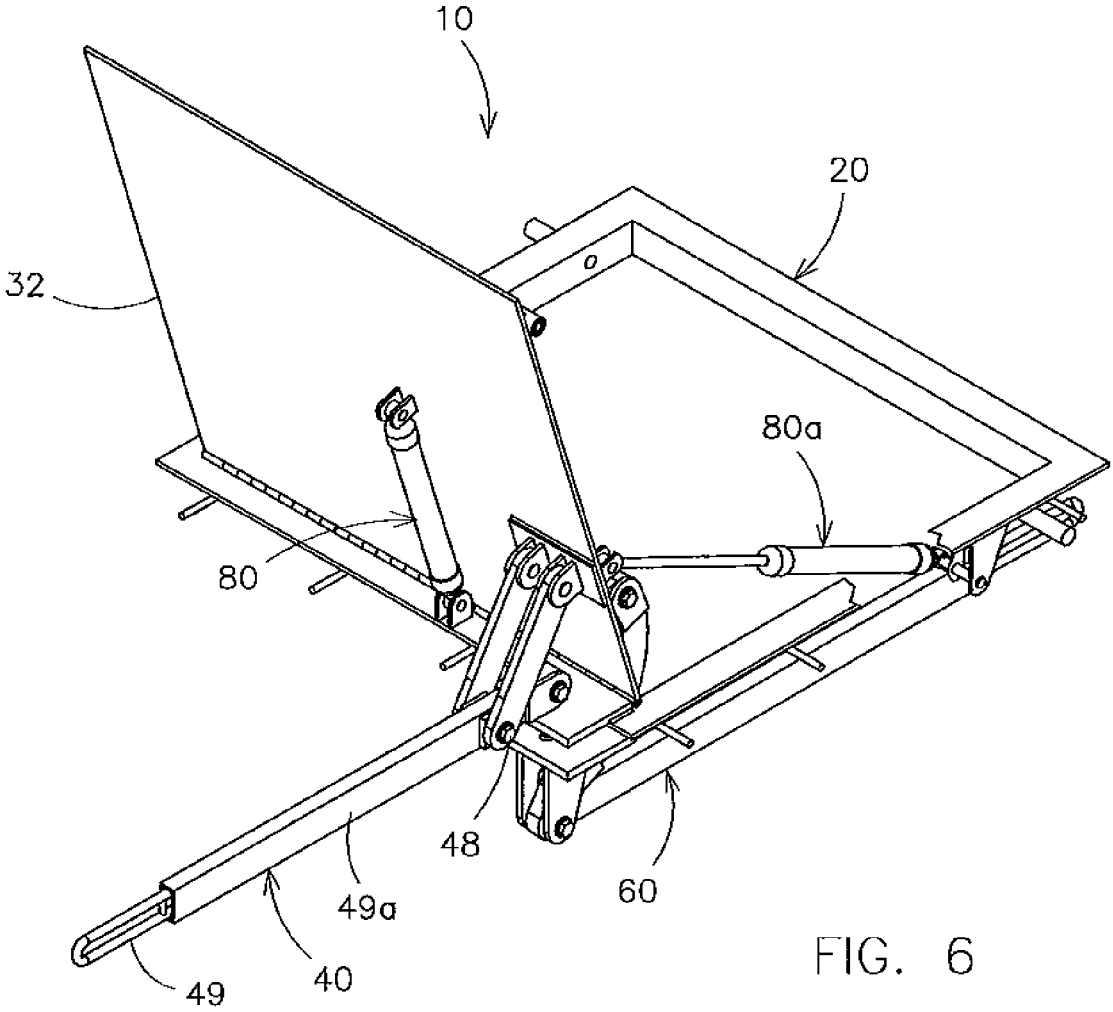
FIG. 6 represents an isometric view of the door assembly with door panel 32 at one extreme position (open) and the use of gas springs assemblies 80; 80*a* coupled to moving door panel 32.

As it can be seen from FIG. 6, the moment of force created by a user will be a force he/she applies to lever assembly 40, and particularly at the distal end of member 49 when distended. This will maximize the moment of force applied. The pivot point for lever assembly 40 is at shaft 42.

Figure 3B:
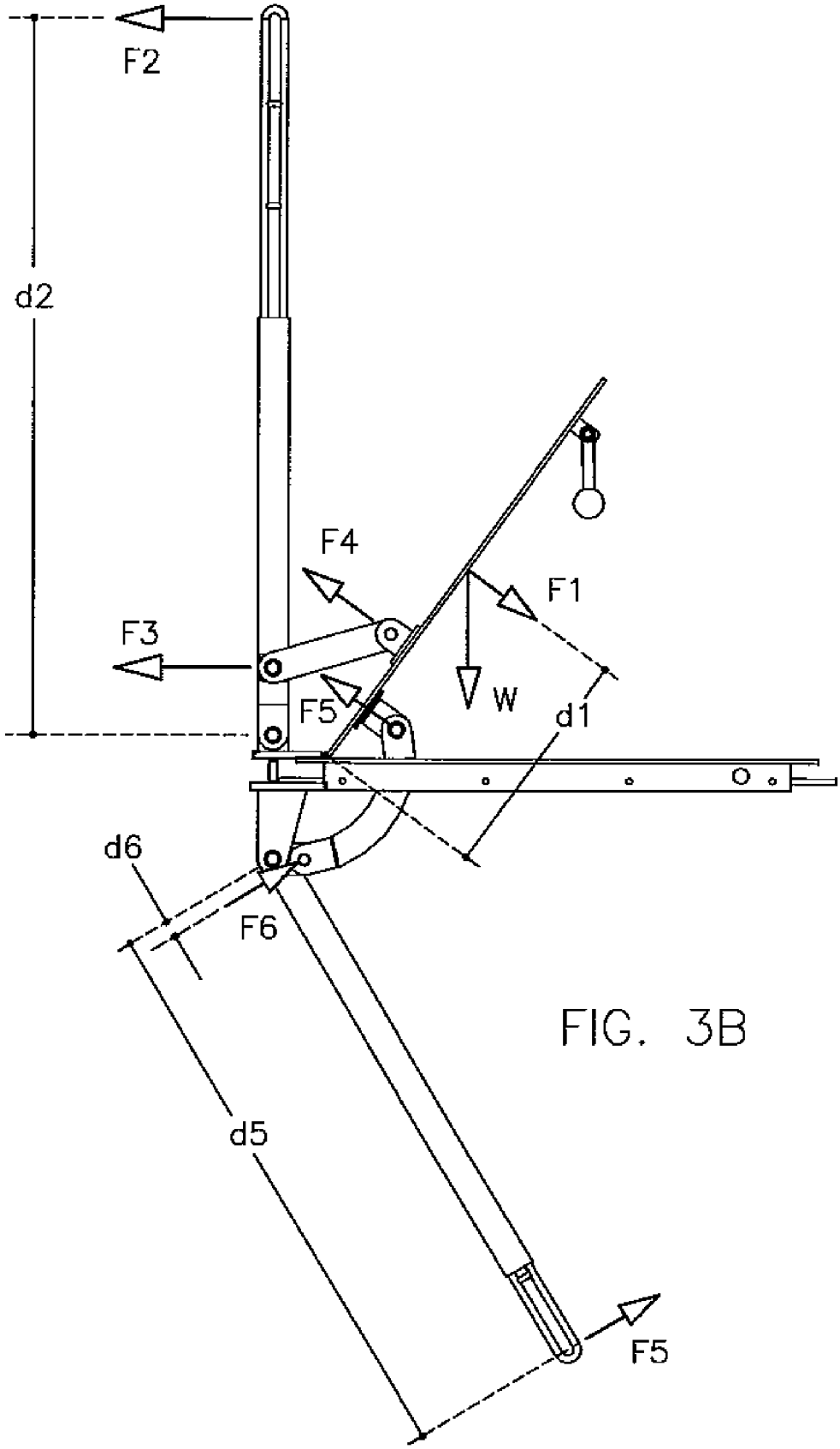
FIG. 3B is a representation of lever assemblies 40 and 60 along with door panel 32 and the location of the pertinent vertical forces.

Door assembly 30 pivots about its hinge member 22, which extends at a parallel and spaced apart relationship with respect to the pivot axis at shaft 42. As best seen in FIGS. 2 and 3, connecting arm 46 has end 46*a* pivotally mounted to pivoting shaft 47, which runs parallel and at a spaced apart relationship with respect to the axis of hinge member 22. The other end 46*b* of connecting arm 46 is pivotally connected to lever assembly 40 through pivoting shaft 48. As best seen in FIG. 3B, the moment $F_6 \cdot d_1$ created by the weight of door panel 32 needs to be overcome by the moment produced about shaft 48 by the vertical (perpendicular to lever assembly 40) component $F_2 \cdot d_2$. See FIG. 3. This moment of force is converted to $F_3 \cdot d_3$ and is transmitted through connecting arm 46 to door assembly 30, which is pivotally engaged at the pivoting point at shaft 47. The moment of force transmitted to door panel 32 will be the product of distance $d_4$ (distance from hinge 22 to the pivoting point at shaft 47) and force $F_4$ is applied at that point. Thus, the moment $F_4$ times $d_4$ needs to overcome the moment produced by the vertical component force $F_1$, which corresponds to the weight of door panel 32 applied at its center of gravity, which is a distance $d_1$ from the pivoting point at hinge 22.

Similarly, in FIG. 3B, the moments of force produced by lever assembly 60 are shown. Force $F_5$ is applied by a user perpendicularly on lever member 69 at its distal end. The pivoting point for assembly 60 is at shaft 62 and the distance $d_5$ multiplied by $F_5$ provides the user's moment of force that is converted to moment $F_6$ times the distance $d_6$ from the pivoting point at shaft 62 to the projection of the pivoting point at shaft or pin 63 located at the distal end of angled plate 67. Distance $d_6$ runs from the pivoting point of shaft 62 to the projection of the pivoting point at pin 63 on lever assembly 60. Distance $d_6$ is considerably smaller than distance $d_5$, thereby achieving a large multiplier for force $F_5$. Force $F_6$ is transmitted as force $F_7$ to door panel 32 at shaft or pin 61, which is at a distance $d_7$ from hinge 22. Force $F_7$ multiplied by distance $d_7$ provides a moment of force that overcomes $F_1$, which is the perpendicular component of the weight W of door panel 32 multiplied by the distance $d_1$ from hinge 22 to the center of gravity of door assembly 30.

Curved connecting arm 66 cooperates to clear bearing members 64; 64*a*. The location of the pivoting points at pins 61 and 63 for ends 66*a*; 66*b* of curved connecting arm 66 are also selected to clear bearings to cooperate with arm 66, as best seen in FIG. 2. Pin 61 is mounted to bearing member 68, keeping the former at a predetermined spaced apart relationship with respect to the plane of door panel 32.

The multiplier for force $F_5$ is achieved by the ratio of the distance $d_5$ over $d_s$. The maximum length of extended lever assembly 60 is limited, in the case if a storm enclosure, by the height of the enclosure. Lever assembly 40 may have fewer limitations, depending on the physical surroundings.

As seen in FIG. 6, gas spring assemblies 80; 80*a* are mounted to reduce the moment of force required by a user as door panel 32 moves away from its perpendicular position. When door panel 32 is in the horizontal position, gas spring assemblies 80 urge the former to move counterclockwise. When door panel 32 is to the left of the perpendicular position, gas spring assemblies 80; 80*a* urge door panel 32 to move clockwise. When door panel 32 is perpendicular, very little force is needed to move it since the weight is vertically transmitted to hinge member 22.

Figure 7:
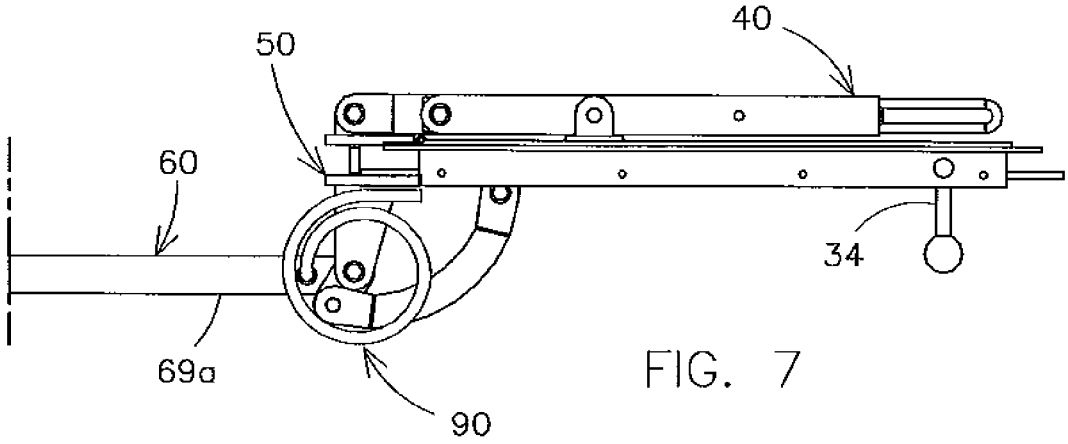
FIG. 7 shows an alternate embodiment where a coil spring 90 is used to facilitate the opening and closing of door panel 32. In this position of inner lever assembly 60, coil spring 90 is in the compressed state exerting a force on assembly 60 at the end of member 69*a*, urging assembly 60 to move counterclockwise.
Figure 8:
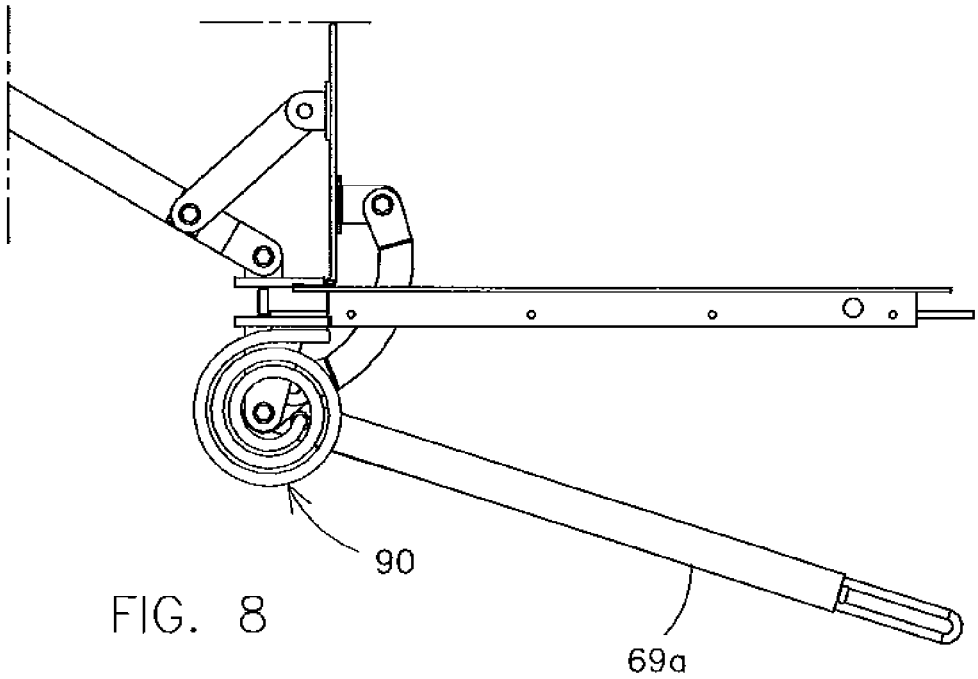
FIG. 8 is similar to the previous figure except that assembly 60 has traveled counterclockwise approximately 150 degrees, bringing door panel 32 to a substantially perpendicular position where it requires a minimum of force on assembly 60 to move it.

In FIGS. 7 through 9, another alternate embodiment using coil spring 90 is shown. Coil spring 90 is mounted to a fixed point at inner plate 54 on one end 92 and the other end 94 of coil spring 90 is mounted to inner lever assembly 60 to member 69*a*, as best seen in FIG. 9A. Coil spring 90 is mounted in such a manner that it is at rest when door panel 32 is at a substantially perpendicular position. Coil spring 90 is at compression, in this embodiment, when assembly 60 is at the zero degree position, as seen in FIG. 7. Coil spring 90 is at rest, when door panel 32 is at a substantially perpendicular position, as seen in FIG. 8. Coil spring 90 is at the distended stage when the door panel 32 is as shown in FIG. 9.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A door assembly, comprising:

A) a frame assembly mounted to a structure to be protected defining an opening;

B) a door panel having an inner surface and an opposite outer surface hingedly mounted to said frame assembly along a reference pivoting first axis, said door panel having its center of gravity located along a center of gravity axis at a first predetermined distance from said first axis;

C) an outer lever assembly connected to said outer surface and having elongated first and second members slidably and telescopically mounted to each other, said first member being pivotally mounted to a reference pivoting second axis outside of said frame assembly and said second axis extending at a parallel and spaced apart relationship with respect to said first, and said second member selectively and slidably moving within said first member, said second member including a distal end for the application of a user's force at a second predetermined distance from said second axis, and further including a connecting arm with first and second ends, said first end being pivotally mounted to said first member at a third predetermined distance from said second axis and said second end being pivotally mounted to said door panel at a fourth predetermined distance from said first axis, said fourth predetermined distance being longer than said third predetermined distance; and D) an inner lever assembly connected to said inner surface and having elongated third and fourth members telescopically mounted to each other, said third member being pivotally mounted to a reference pivoting third axis outside of said frame assembly, below said second axis, and extending at a parallel and spaced apart relationship with respect to said first and second axes, said fourth member selectively and slidably moving within said third member, said fourth member including a distal end for the selective application of a user's force at a fifth predetermined distance from said third axis, and further including a connecting curved arm having third and fourth ends, said third end being pivotally mounted to said third member at a sixth predetermined distance from said third axis and said fourth end being pivotally mounted to said door panel at a seventh predetermined distance from said first axis, said seventh predetermined distance being longer than said sixth predetermined distance, thereby achieving a force multiplier through the application of resulting moments of force to permit the opening and closing of said door assembly using a minimum of force applied by the user.

2. The door assembly set forth in claim 1 wherein said second and third axes are vertically aligned.

3. The door assembly set forth in claim 2 wherein said third member includes an angled member rigidly mounted thereon and extending outside of said third member's axis to pivotally receive said third end.

4. The door assembly set forth in claim 3 wherein said inner assembly further comprises at least one gas spring assembly coupled to said door panel and at least one gas spring assembly adjusted to exert minimal force upon said third member when said door panel is in a substantially vertical position and oppose the moment of force exerted by said door panel when off of the vertical position.

5. The door assembly set forth in claim 4 wherein said door panel further includes a locking assembly to keep said door panel selectively locked with respect to said frame assembly.

6. The door assembly set forth in claim 3 wherein said inner lever assembly further comprises a coil spring cooperatively mounted to exert substantially no force upon said third member when said door panel is at a substantially vertical position and to oppose the moment of force exerted by the weight of said door panel when off-centered.

7. The door assembly set forth in claim 6 wherein said door panel includes locking assembly to keep said door panel selectively locked with respect to said frame assembly.

* * * * *